United States Patent [19]

Buckholtz et al.

[11] Patent Number: 5,019,157

[45] Date of Patent: May 28, 1991

[54] METHOD OF MAKING EUTECTIC MIXTURE OF COPPER AND TRICOPPER PHOSPHIDE

[75] Inventors: Harry E. Buckholtz; George T. Miller, both of Lewiston, N.Y.

[73] Assignee: Occidental Chemical Corporation, Niagara, N.Y.

[21] Appl. No.: 383,502

[22] Filed: Jul. 24, 1989

[51] Int. Cl.[5] ..... C22C 9/100

[52] U.S. Cl. ..... 75/340; 420/499

[58] Field of Search ..... 420/499; 423/299; 75/351, 352, 340

[56] References Cited

U.S. PATENT DOCUMENTS 4,192,853 3/1980 Chernogorenko et al. ..... 75/68 R

OTHER PUBLICATIONS

"Phosphorus" by Arthur D. F. Toy in Comprehensive Inorganic Chemistry, pp. 406 and 407, 1973.

*Phosphorus and Its Compounds* by John R. Van Wazer, vol. 1, p. 132, 1958.

*Primary Examiner*—Melvyn J. Andrews

*Attorney, Agent, or Firm*—James F. Tao

[57] ABSTRACT

Disclosed is a method of making a eutectic mixture of copper and tricopper phosphide by reacting elemental copper with phosphine. The elemental copper is heated to a temperature above about 714° C. and the liquid eutectic mixture runs off of the cooper as it is formed, exposing more copper for reaction. The liquid eutectic mixture can be used as a source of copper and phosphorus in making metal alloys.

11 Claims, 1 Drawing Sheet

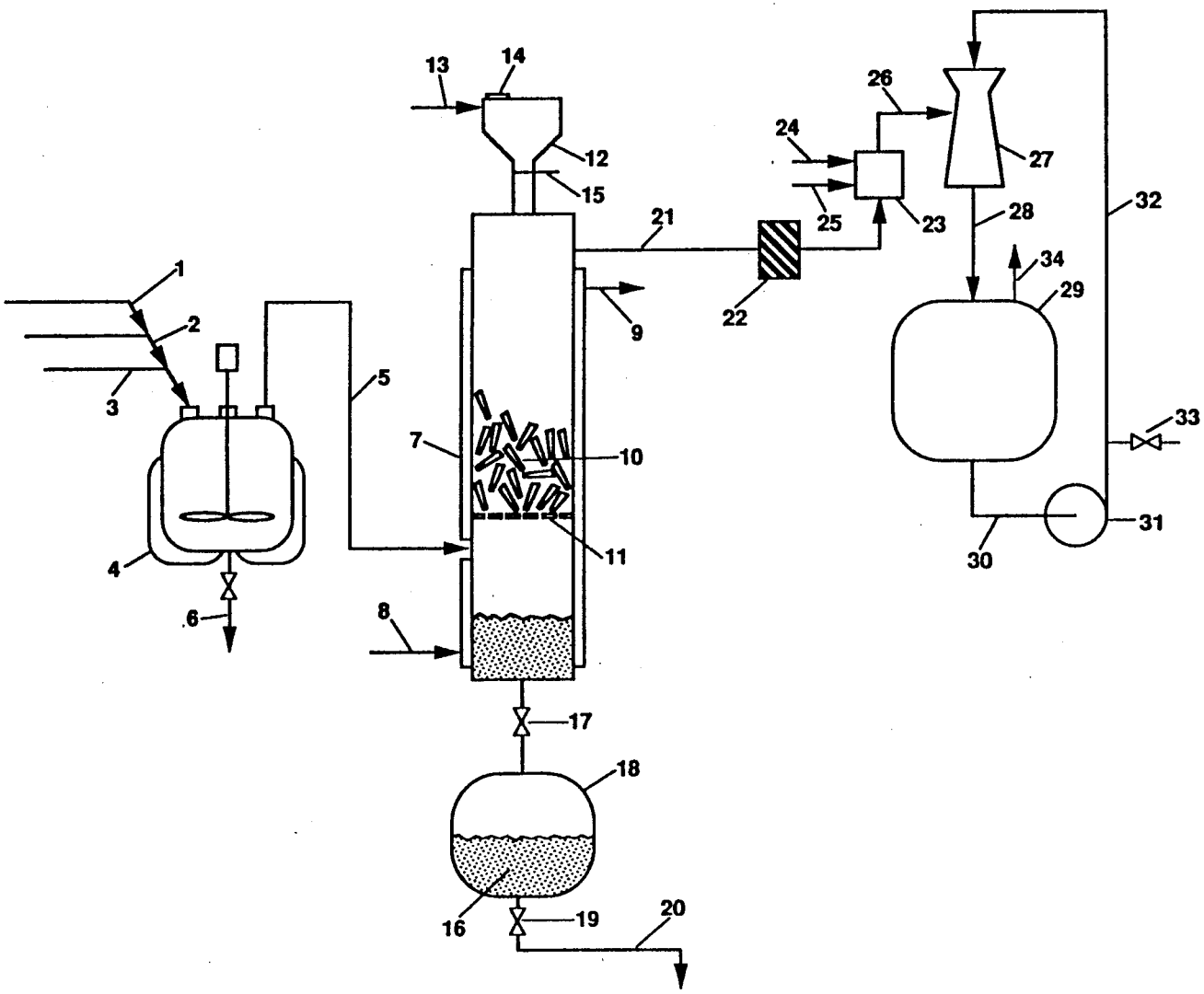
1
2
3
4
5
6
7
8
9
10
11
12
13
14
15
16
17
18
19
20
21
22
23
24
25
26
27
28
29
30
31
32
33
34

METHOD OF MAKING EUTECTIC MIXTURE OF COPPER AND TRICOPPER PHOSPHIDE

BACKGROUND OF INVENTION

This invention relates to a method of making a eutectic mixture of copper and tricopper phosphide by the reaction of phosphine with elemental copper.

Copper phosphide, $Cu_3P_2$, and tricopper phosphide, $Cu_3P$, are used as a source of copper and phosphorus in making alloys of steel, bronze, and other metals. The only process currently employed to produce the copper phosphides is a batch process which involves directly combining elemental phosphorus and molten copper. This operation is dangerous due to the use of elemental phosphorus, which is not only toxic, but can ignite spontaneously upon contact with air.

There are other sources of phosphorus, such as phosphorus contaminated sludge, but phosphorus from those sources has not been commercially utilized in making copper phosphide. Indeed, in elemental phosphorus production, phosphorus contaminated sludge is regarded as a valueless by-product and the phosphorus in it is a dangerous contaminant that can become an environmental pollutant. In elemental phosphorus production a stable emulsion of phosphorus, water, and dirt is produced which contains elemental phosphorus. Since the elemental phosphorus is under water, it is not oxidized and remains as elemental phosphorus. While this sludge can be stored in ponds, it is very toxic, and, if it escapes into the environment and seeps into streams, it can kill fish at extremely low concentrations. The phosphorus can be removed from the sludge by a costly energy intensive processing involving evaporation of both the water and the phosphorus at temperatures of over 300° C. At high phosphorus concentrations this may be economical, but a low phosphorus levels evaporation is extremely unattractive. Thus, at low concentrations (e.g., 10% or less) the phosphorus in the sludge only adds to the expense of the industrial process producing the sludge, though it would be valuable if it could be used to make copper phosphide.

SUMMARY OF INVENTION

I have discovered that a eutectic mixture of copper and tricopper phosphide can be produced by reacting copper with phosphine according to the equation:

$$6Cu + 2PH_3 \rightarrow 2Cu_3P + 3H_2.$$

The eutectic mixture is a liquid which runs off the copper exposing more copper for reaction with the phosphine. The liquid eutectic mixture can then be collected, cooled, and solidified for use as a source of copper and phosphorus in making alloys or for other uses.

Unlike the prior process for making copper phosphide, the process of this invention does not involve the direct use of elemental phosphorus and is therefore considerably safer. In addition, the process of this invention can operate as a continuous process to make shot or waffle and is not subject to the limitations of the previous batch process for making copper phosphide.

In addition, I have found that small amounts of elemental phosphorus in aqueous sludges can be utilized as a source of phosphine in the process of this invention. Not only is the sludge rendered much less toxic or even harmless by the removal of the phosphorus, but the phosphorus is now turned into one or more valuable products.

DESCRIPTION OF INVENTION

The accompanying drawing is a diagrammatic view of a certain presently preferred embodiment of the process of this invention.

In the drawing, quicklime (CaO) or slaked lime ($Ca(OH)_2$) in line 1, water in line 2, and elemental phosphorus or a phosphorus containing sludge in line 3 are mixed in mixer 4 resulting in the production of phosphine and hydrogen in line 5 and a calcium phosphite and calcium hypophosphite slurry in water in line 6. The phosphine and hydrogen gases in line 5 are sent to reactor 7 which is heated by a fluid admitted in line 8 and passing out through line 9. Reactor 7 contains solid chunks of scrap copper 10 which rest on perforated plate 11. The copper is admitted to reactor 7 through feed hopper 12 which can be purged with an inert gas through line 13. Hopper 12 is provided with a cover 14 and a slide gate 15, which can be opened to allow the copper chunks 10 to fall into reactor 7. As the phosphine reacts with the solid copper 10, a molten eutectic mixture of copper and tricopper phosphide 16 is formed which runs off copper 10 through perforated plate 11 into the bottom of reactor 7. By opening valve 17 moltent eutectic mixture 16 can be collected in heated or insulated product reservoir 18. When valve 19 is opened molten eutectic mixture 16 passes through line 20 into molds (not shown), forming a waffle product, or into a water quench (not shown), forming shot. The residual gases pass out of reactor 7 through line 21 past flame arrester 22 into residual gas burner 23, where natural gas in line 24 and air in line 25 are admitted to burn the residual gases. The burned gases pass through line 26 to venturi 27, then through line 28 to residual phosphorus pentoxide scrubber tank 29. The phosphoric acid in scrubber tank 29 passes through line 30 to recirculating pump 31, then back to venturi 27 through line 32 with excess acid removed through valve 33 and residue gases vented through vent 34.

In the process of this invention, phosphine is reacted with elemental copper to produce a eutectic mixture of copper and tricopper phosphide. Any source of phosphine may be used, including phosphine produced as a by-product from other chemical reactions, such as, for example, the alkaline hydrolysis of white phosphorus to produce sodium hypophosphite. Phosphine can also be obtained from aqueous sludges which contain elemental phosphorus. These are usually siliceous sludges produced as a result of industrial processes which may contain less than one percent up to over 80 percent of elemental phosphorus. The use of any strong alkali, such as caustic soda, potassium hydroxide, or calcium carbonate, will hydrolize the elemental phosphorus in an aqueous slurry to produce phosphine. However, the preferred alkalis are calcium oxide or calcium hydroxide because they generate the greastest proportion of phosphine from the available phosphorus, about 26%. Alkalis other than calcium oxide or calcium hydroxide generate a proportionately lesser amount of phosphine, and more hypophosphite $(H_2PO_2)^{-1}$ or phosphite $(HPO_3)^{-2}$. The reaction of calcium oxide with phosphorus results in the formation of phosphine according to the empirical equation:

$$2.05CaO + 6.42H_2O + 1.00P_4 \rightarrow 1.05PH_3 + 0.57(2CaHPO_3.3H_2O) + .91[Ca(H_2PO_2)_2]$$

The phosphine produced can be collected and used in the process of this invention as depicted, for example, in the accompanying drawing.

Any source of copper can also be used in this invention. Since the copper need not be pure, it is preferable to use scrap copper as that is an inexpensive source of copper. It is also preferable to use non-pulverulent copper because it is more difficult for the phosphine to penetrate into powdered copper and it is more difficult for the liquid eutectic mixture formed to run off powdered copper. The copper should be heated above the melting point of the eutectic mixture (714° C.), but the copper need not be heated above its own melting point (1083° C.), as that is unnecessary and complicates the process. Preferably, the copper is heated to a temperature of about 714° C. to about 800° C. as that is the most practical range. Heating can be accomplished by any convenient method, including radiant heating, electrical heating, and direct heating with a preheated inert gas. It is not necessary to preheat the phosphine as it will be heated upon contact with the copper.

When the phosphine contacts the copper it almost instantly reacts to form a liquid eutectic mixture of copper and tricopper phosphide which contains, at the eutectic point, 8.38% by weight phosphorus and 91.62% by weight copper. The eutectic mixture flows off of the copper, exposing more copper for reaction with the phosphine. If the copper is in the form of bulk pieces, the pieces can be placed on a grid so that the liquid eutectic mixture flows through the grid and can be easily collected. If the liquid eutectic mixture is fed dropwise into water, shot is formed, and if it is fed into a mold and allowed to cool and solidify, waffles are formed. The eutectic mixture can be used in making metal alloys.

The following examples further illustrate this invention:

EXAMPLE

A strip of pure copper approximately 178"×4"×0.010" (30 gauge) was placed in a one inch diameter quartz tube which has inserted into a tube furnace. Under a nitrogen atmosphere, the tube was heated to a bright red meat of approximately 850° C. as checked with a thermocouple. Pure phosphine gas was admitted, and the nitrogen was turned off. The flow was adjusted until a very small flame of burning phosphine was detectable on the exit of the tube. The experiment was run for 10 minutes, the heat was turned off, the phosphine was purged out with nitrogen, and the tube was removed from the furnace to cool. Part of the copper sheet was intact, but the portion nearest to the inlet of gas had melted down. The melted portion was crushed in a mortar and was analyzed to contain about 8% by weight phosphorus.

This experiment shows that phosphine will react with metallic copper below the melting point of the copper and that the resulting eutectic mixture of copper and tricopper phosphide will flow away from the unreacted copper.

I claim:

1. A method of making a molten eutectic mixture of copper and tricopper phosphide comprising (1) placing elemental copper in a furnace;

(2) heating said copper to a temperature between 714° C. and 1083° C.;

(3) contacting said heated copper with phosphine, whereby said molten eutectic mixture forms on said copper; and (4) separating said molten eutectic mixture from said copper.

2. A method according to claim 1 wherein said copper is heated to a temperature below 800° C.

3. A method according to claim 1 wherein said copper is non-pulverulent.

4. A method according to claim 1 wherein said mixture is fed dropwise into water, forming shot.

5. A method according to claim 1 wherein the said mixture is fed into a mold and allowed to cool and solidify, forming waffles.

6. A method according to claim 1 wherein said phosphine gas is made by adding alkali to aqueous sludge containing elemental phophorus.

7. A method according to claim 6 wherein said alkali is calcium hydroxide or calcium oxide.

8. A method of making a eutectic mixture of copper and tricopper phosphide comprising (1) placing non-pulverulent elemental copper on a grid in a furnace;

(2) heating said copper to a temperature between about 714° C. and about 800° C.;

(3) contacting said heated copper with phosphine; and (4) collecting said eutectic mixture which runs through said grid.

9. A method according to claim 8 wherein said eutectic mixture is run into water to form shot.

10. A method according to claim 8 wherein said eutectic mixture is run into a mold to form waffles.

11. A method according to claim 8 including the addition first step of adding calcium hydroxide or calcium oxide to aqueous sludge containing elemental phosphorus to obtain said phosphine.

* * * * *